United States Patent [19]

Richey

[11] 4,452,611

[45] Jun. 5, 1984

[54] DOWNDRAFT CHANNEL BIOMASS GASIFIER

[76] Inventor: Clarence B. Richey, 2217 Delaware Dr., West Lafayette, Ind. 47906

[21] Appl. No.: 381,068

[22] Filed: May 24, 1982

[51] Int. Cl.[3] ..... C10J 3/20

[52] U.S. Cl. ..... 48/111; 48/63; 48/76; 48/113; 110/229; 110/255

[58] Field of Search ..... 110/255, 229, 298, 299, 110/300, 346; 48/113, 111, 63, 76

[56] References Cited

U.S. PATENT DOCUMENTS

| | | | |
|---|---|---|---|
| 3,710,449 | 1/1973 | Rathbun | 34/170 |
| 4,235,024 | 11/1980 | Chauvin et al. | 34/57 A |
| 4,388,082 | 6/1983 | Guttman et al. | 48/76 |

*Primary Examiner*—S. Leon Bashore, Jr.
*Assistant Examiner*—K. M. Hastings
*Attorney, Agent, or Firm*—Zarley, McKee, Thomte, Voorhees & Sease

[57] ABSTRACT

A downdraft channel gasifier for the efficient conversion of biomass materials to usable heat energy, which includes at least two generally triangularly shaped air ducts positioned longitudinally across an enclosed housing defining a combustion chamber. The air ducts have sloping sides which downwardly converge towards one another to define at least one open-bottom V-shaped channel, the sloping sides primarily supporting the biomass fuel which will be combusted to derive producer gas. The air ducts are hollow and are in fluid communication with a high pressure air source at one end, and with the gasification chamber through air jet openings near their apexes. The high pressure air exits out air jet openings along the top edges of the air ducts, providing primary air for gasification of the biomass in the channels. The producer gas passes down between the channels and horizontally to an exit.

19 Claims, 7 Drawing Figures

DOWNDRAFT CHANNEL BIOMASS GASIFIER

BACKGROUND OF THE INVENTION

1. Field of Invention

This invention relates to biomass gasifiers, more particularly to downdraft-channel gasifiers for the efficient conversion of biomass materials to usable heat energy or fuel for internal combustion engines.

2. Description of the Prior Art

The depletion of our non-renewable petroleum energy resources has caused increased interest in renewable biomass energy resources. The potential energy contained in crop residues, wood residues, and biomass crops all present attractive possibilities for reducing our dependence on fossil fuels.

Modern agricultural industry has a particular dependence upon petroleum energy. Not only are huge quantities of petroleum fuels consumed by equipment used in field work, but drying corn can require twice the heat energy of the liquid fuel required for crop production operations, including harvesting. Therefore, there is a real need for a furnace to efficiently burn biomass and produce heat for drying farm crops. Drying corn with corn cobs represents a major opportunity for reducing the dependence of Corn Belt farmers on fossil fuels, since the heat from one cob can dry the grain from at least three ears of corn.

The efficient conversion of biomass materials to usable heat energy requires a different technology than that developed for petroleum products and coal. The major differences are as follows:

1. Usually the biomass material is not free-flowing, and is often not in uniform discreet particles, thus it requires complex handling and feeding equipment.
2. Biomass material contains a high proportion of volatile material (up to 80%) which vaporizes very rapidly and can cause much smoke and loss of energy if combustion is not controlled and completed.
3. Many biomass materials contain silica and the ash fuses into an adherent slag at temperatures above 800° C. (1472° F.).
4. Biomass material has a high moisture content as grown and requires natural or artificial drying before use as a fuel.

Direct combustion of biomass materials usually results in smoke and ash pollution unless special filtering equipment is used. Smoke from wood-fired household stoves or fireplaces may cause tar (creosote) deposits in the chimney which may eventually ignite, emit dangerous sparks, overheat chimneys and cause fires. Heat exchangers are often needed in order to avoid contamination of the area or the material being heated.

In attempts to solve many of the problems associated with direct combustion, devices have been built which gasify biomass materials to produce a combustible gas which could in turn be used for heating purposes. Gasification is the process whereby biomass is burned with limited air (gasified) to produce an exhaust gas (producer gas) which contains enough CO, $H_2$ and some $CH_4$ to be combustible. This gas is drawn off to a secondary combustion chamber where heat energy is produced with little or no smoke or ash or it can be used to fuel internal combustion engines.

One comparative drawback is that this gas's heating value is only 3.72–7.45 MJ/m3 (100–200 Btu/ft3) compared to 37.2 MJ/m3 (1000 btu/ft3) for natural gas.

Producer gas is diluted by the inert nitrogen in the combustion air, by the $CO_2$ produced during combustion, and by water vapor; hence, its low heat value.

The gasification process has been in use for a considerable period of time. The producer gas derived from the gasification of coal was in common use before natural gas became available; but as stated before, conversion of biomass materials to usable heat energy (including gasification) differs markedly from methods developed for petroleum products and coal.

The major experience with gasification occurred during World War II when Sweden and other northern European countries could not obtain petroleum. Portable gasifiers using charcoal or wood chips were used to produce gas to power motor vehicles and tractors, although with greatly reduced power and convenience.

During that time, it was also found that a special type of gasifier, called a downdraft gasifier, could produce a gas from wood chips usable by motor vehicles, whereas the more widely known updraft gasifiers required charcoal fuel to avoid excessive tar. About half of the heating value of wood is lost in making a charcoal, so direct use of wood chips is much more efficient.

Gasifiers are usually classified as being updraft, downdraft, or sidedraft (crossdraft). With updraft gasifiers, air is blown or drawn up through a grate supporting the biomass, and this producer gas passes up through the combustion zone and the unburned fuel and out an exit at the top for use. Downdraft gasifiers, on the other hand, force the producer gas down through the combustion area by means of air pressure or air suction to an exit for use.

Conventional gasification of biomass is attractive for crop drying because it is possible to burn the producer gas like natural or LP gas without visible smoke or particulates. Clean combustion will allow the flue gas to be mixed with ambient air and used for drying of crops, as with natural or LP gas. However, if the producer gas cools as it is piped from the gasifier to the burner-dryer fan assembly, any tars may condense in the pipe. Possible advantages of gasification over direct combustion of biomass for drying crops are:

1. Minimum air pollution and direct-drying of the product without the necessity of using a heat exchanger which reduces efficiency and adds equipment expense.
2. More efficient conversion of biomass to heat, with 80–90% of its heat recovered.
3. Control of combustion rate by regulating primary air flow.

Research and development of large-scale gasifiers for crop drying is being attempted. In particular, updraft gasifiers of up to 9488 MJ/hr (9 million Btu/hr) capacity are being developed by seed corn companies to utilize their by-product corn cobs as a fuel for drying their ear corn.

However, updraft gasifiers present significant problems when used as suppliers of gas for drying of corn. Although sufficient air may be supplied to promote gasification, high oxidation temperatures create slagging problems. Also, the gases which are produced do not pass through a cracking zone and are difficult to burn cleanly without tar. Finally, incomplete combustion creates exhaust by-products which may discolor and impose an unfavorable and detrimental odor to the corn which is being dried.

Downdraft gasifiers were developed in an effort to reduce tar content in gas used to power internal combustion engines. In conventional downdraft systems, the air enters through peripheral jets directed toward the center of the airtight cylindrical fuel and combustion chamber just above a funnel-shaped or conical bottom to initiate gasification. As the biomass is devolatilized by combustion and heat, it shrinks into pieces of carbon or char which accumulate in a conical bottom and are supported on a grate below the throat. The char forms a red-hot bed which reduces $CO_2$ to combustible CO and also cracks the tars into stable gases. These can then be cleaned and cooled for use by an engine. Problems with this type of gasifier are primarily associated with the fact that a conical bottom downdraft gasifier does not scale up efficiently for high gas generating capacity, such as needed for drying corn with corn cobs. This is so because as the size of the conical or funnel-shaped bottom where the combustion air enters is increased, the peripherally-introduced air has more difficulty in penetrating the fuel mass uniformly and producing a uniform char bed in the bottom of the cone. It is the passing of the producer gas through glowing char which cracks the gas into shorter chain hydrocarbons. Therefore, less uniform cracking of the hydrocarbons will be accomplished; and the producer gas will not be as clean as desired. Combustion with limited air to produce CO instead of $CO_2$, is not so much a matter of limiting the air as it is of distributing the available air throughout the fuel mass to contact the greatest possible fuel surface area.

A new concept, called channel gasification, was devised by this applicant in an attempt to obtain the low-tar producer gas of the downdraft type of gasifier, but having a large bed area, uniformly supplied with air, as obtainable with a high-capacity updraft type. A large gasifier of this type might permit the gasification of hay, straw, and corn fodder in large, round bales or small stacks, as well as biomass in discreet particles such as corncobs or wood chips.

In the applicant's original channel gasifier prototypes, the biomass material rested on a corrugated floor of a chamber with a tight cover with the material supported primarily on inverted V-shaped or triangular air ducts, leaving open or air-permeable V-shaped channels defined by the air ducts. Combustion air flowed into the channels from holes along the air duct top edges. Burning of the biomass material took place in the channels and the material moved down by gravity as burning proceeded. Producer gas traveled longitudinally in the channels to end outlets.

The primary virtue of the channel concept is its capability for scaling up without losing efficiency, along with its simplicity, its cooling capability and its adaptation to fabrication from steel sheets. Therefore, downdraft channel gasification offers the potential of overcoming the problem inherent in the previously downdraft conical bottom gasifiers, thus allowing scale-up with efficiency. Corncobs, chopped corn stover, wheat straw, sawdust, wood chips from prunings, and wood scraps can be successfully burned with little or no smoke.

Possible advantages of channel downdraft gasification with close-coupled gas combustion over conventional updraft gasifiers are:

1. Tars are burned before they can condense.
2. The design does not require that combustion air pass through the biomass fuel. Any combustible biomass material which will feed down in a straight-sided chamber and will also be primarily supported on the air ducts can be used.
3. The fuel in the gasifier chamber burns almost completely to ashes with little char remaining.

The applicant's original channel gasifiers were constructed to be of the cross-draft type. Air was introduced from holes in the ridge tops and gas flowed longitudinally in the channels to end outlets. However, problems were found with this system. The gases produced in the cross-draft gasifier above the channel near the exit passed through very little glowing char compared to gases originating at the opposite end, giving inadequate cracking action.

It is therefore an object of this invention to provide a downdraft channel gasifier which provides for efficient gasification and uniform cracking action of the long-chain hydrocarbons inherent in the producer gas.

A further object of this invention is to provide a downdraft channel gasifier which presents multiple channels to which are supplied uniform primary air creating a uniform bed of combusting biomass for efficient gasification and cracking of the long-chain hydrocarbons inherent in the producer gas.

A further object of this invention is to provide a downdraft channel gasifier which provides for the efficient conversion of biomass materials to usable heat energy or fuel for internal combustion engines.

Another object of this invention is to provide a downdraft channel gasifier which produces lower combustion temperatures compared to direct combustion or updraft gasification, reducing the cost of furnace materials and also reducing the formation of slag which can block air openings, etc.

Another object of this invention is to provide a downdraft channel gasifier which reduces the tar content in the producer gas.

Another object of this invention is to provide a downdraft channel gasifier which takes advantage of the bridging characteristics of most biomass fuels by supporting them on triangular ducts which also furnish combustion air which cools the duct material as the air is preheated.

Yet another object of this invention is to provide a downdraft channel gasifier which results in hotter and cleaner burning gas.

Additional objects, features, and advantages of the invention will become apparent with reference to the accompanying specification and drawings.

SUMMARY OF THE INVENTION

This invention utilizes an expanded-mesh mild steel grate, above which are mounted elongated horizontally disposed hollow air ducts of generally triangular configuration inside of a gasification chamber defined by an enclosed housing. Each adjacent air duct has at least one sloping side which extends convergingly downward from an apex edge towards a reciprocal sloping side of an adjacent air duct. These sides serve to define V-shaped open-bottom channels.

The grate and air ducts are located towards the bottom of the chamber. The apex edges and sloping sides of the air ducts support the biomass fuel, such as corn cobs, which is loaded from the top of the chamber.

The air ducts extend longitudinally across the entire width of the chamber. Pressurized air is introduced into air-entrance ends of the air ducts via a high pressure blower, which is in communication with the air ducts by an air manifold. The hollow air ducts have a plurality of equally spaced apart air jet openings located along their apex edges. Some of the pressurized air entering the air ducts exits through these air jets into the gasification chamber, providing what is called primary air for the gasification of the biomass.

The remaining pressurized air, called secondary air, passes through the length of the air ducts and leaves through air-exit openings into an adjacent secondary combustion chamber. The gasifier outlets are in fluid communication with both the air ducts and the gasification chamber. As a result of the pressurized primary air, the gas produced by the burning biomass fuel is forced down through the channels formed by the air ducts and longitudinally to exits into the secondary combustion chamber where it is burned to produce heat.

A combustion zone forms at and around the apex edges of the air ducts and is sustained by the primary air supplied by the air jets of the air ducts. Immediately above the combustion zone, there is formed a pyrolysis zone where the biomass fuel is caused to release volatiles and shrink from the heat of the combustion below it. Beneath the combustion zone, a reduction zone comprised of red-hot char or partially combusted biomass forms in the narrowing V-shaped channels. As combustion proceeds, this char passes down through the channels and is supported by the mild steel grate. This red-hot char burns at an extremely high temperature and all the gas leaving through the gasifier outlets is forced to pass through the char. Upon complete combustion, the char reduces to ash and falls through the grate.

The combustion of the biomass gives off a combustible producer gas, which can be used as a fuel source. It contains CO, $O_2$ and cracked long-chain hydrocarbons, along with $N_2$ and some $CO_2$. The downdraft flow forces the lighter-than-air producer gas to pass through the combustion zone and the high-temperature reduction zone, containing the red-hot char, before it passes out of the gasifier outlet. By passing through this char, the long-chain hydrocarbons are further cracked. The resulting producer gas can burn hotter and cleaner. Without this further cracking, the producer gas, when later burned, would create unsatisfactory levels of tar by-products. This is particularly inadequate when using the producer gas as a fuel source for drying corn by the exhaust gas fixed with ambient air because the tar by-products would impart a detrimental odor to the corn.

During the gasification process, the V-shaped channels support the bulk of the uncombusted biomass while the air ducts supply oxidation air to the combustion zone through the air jets. This primary air is distributed uniformly throughout the combustion zone to promote uniform gasification and the creation of a uniform reduction zone of char.

Additionally, the air ducts serve to more or less focus the derived producer gas through the uniform red-hot char bed just above the grate, so that this producer gas is uniformly cracked, thereby providing a cleaner gas for secondary use.

The final, low-tar producer gas exits out of the gasifier outlets, where it combines with the secondary air to create a combustible mixture. Mixing can occur in a secondary combustion chamber which is close-coupled to the gasification chamber. The gas-air mixture is ignited and the heat produced from the combustion is contained in the hot exhaust gases, which are cooled down to temperatures suitable for crop drying by diluting with ambient air, and then used to dry crops. The secondary air used for gas combustion is preheated by passing through the air ducts, because the air ducts are surrounded by the combustion and reduction zones. At the same time, this secondary air serves to cool these air ducts, preserving them and preventing slagging problems.

The ashes which pass through the grate after exhaustion of the char in the reduction zone are deposited in V-shaped troughs running parallel to the air ducts. Augers are positioned longitudinally down these troughs and can be operated at selective times to remove any deposited ash.

The structure of the preferred multiple channel downdraft gasifier which accomplishes these desirable invention results will next be described.

DETAILED DESCRIPTION OF THE PREFERRED EMBODIMENT

Figures 1, 2, 3, 4, 5, 6, 7:
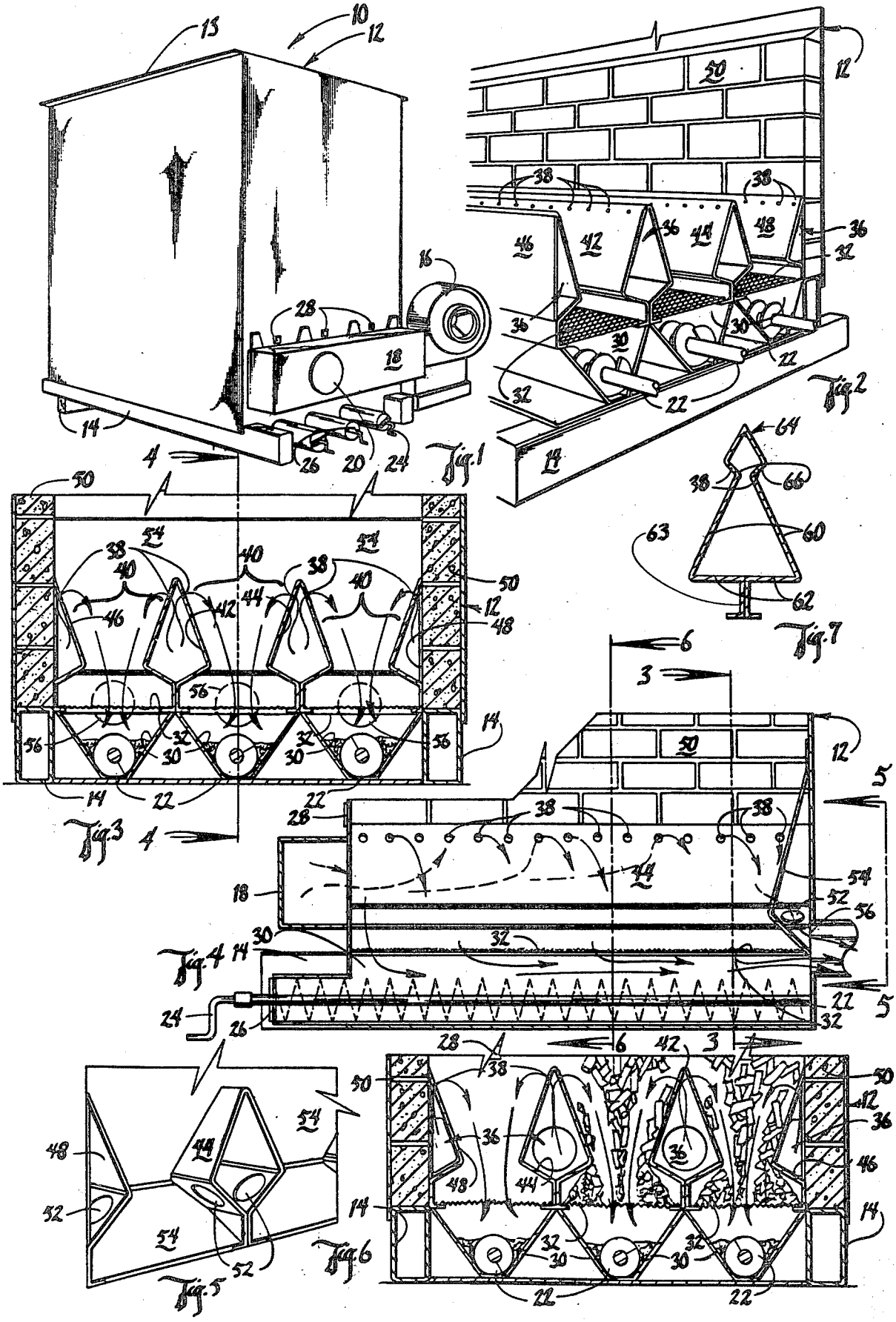
FIG. 1 is a perspective view of the invention.
FIG. 2 is a cut-away perspective view showing the interior of the invention.
FIG. 3 is a partial sectional view of the invention taken along lines 3—3 of FIG. 4.
FIG. 4 is a partial sectional side view taken along lines 4—4 of FIG. 3.
FIG. 5 is a cut-away perspective view of the back side of baffle plate 54 of the invention.
FIG. 6 is a partial sectional view taken along lines 6—6 of FIG. 4.
FIG. 7 is an end sectional view of an alternative embodiment of the air ducts of the invention.

In reference to the drawings, and particularly FIG. 1, there is shown a downdraft channel gasifier 10 in accordance with the invention. A gasifier box 12 with a tight cover 13 forms the basic housing for gasifier 10 and serves to contain the gasification process, the biomass fuel and the by-products of gasification. A base frame 14 of steel tubing provides a rigid foundation for gasifier 10 and allows it to be moved by fork lift.

Combustion air is provided by a high-pressure centrifugal blower 16 with a 27 cm impeller having flat radial blades which directs high pressure air into an air manifold 18. Air manifold 18 includes an inspection hatch 20. Along the bottom of gasifier box 12 there are positioned augers 22 (shown in FIG. 2) which serve to facilitate removal of deposited ashes created by the combustion. Auger handles 24, located externally below air manifold 18 are manually turned to remove the ashes. Before doing so, auger plugs 26, fitted over the openings into gasifier box 12, must be retracted from the auger tubes. Although accumulation of ashes in the augers generally prevents producer gas from escaping along the augers, auger plugs 2 insure that no producer gas escapes in this manner.

Ignition plugs 28 are provided in the end wall of gasifier box 12 to provide access to the fuel for ignition of the biomass.

Referring now to FIGS. 2 and 3, the channels 40 of gasifier 10 can be seen. Augers 22 lie longitudinally in V-shaped troughs 30 which extend along the bottom of gasifier box 12. Directly above troughs 30 are grates 32, which filter out the ashes produced by the combustion. Grates 32 are made of expanded mesh mild steel and have openings large enough for ashes to fall through, but small enough to prevent the biomass fuel and most of the char formed from partially combusted biomass from passing through. Above grates 32 there are positioned air ducts 42, 44, 46 and 48 which, like augers 22, extend longitudinally across the gasifier box 12. As seen in FIG. 2, air ducts 42, 44, 46 and 48 have air entrance openings 36. Air entrance openings 36 are in fluid communication with air manifold 18. Along the top edges of air ducts 42, 44, 46 and 48 are evenly-spaced small air jet openings 38 which discharge a portion of the pressurized air from blower 16 evenly into the biomass fuel near the bottom of gasifier box 12. The air from the jets promotes and sustains the gasification of the fuel and is called primary air. Air ducts 42, 44, 46 and 48 serve to define the channels 40 of gasifier 10. Center air ducts 42 and 44 have two downwardly diverging sloping walls, while side air ducts 46 and 48, being adjacent to the inside walls of gasifier box 12, have only one inwardly sloping wall.

The inside of gasifier box 12 has a lining of insulating brick 50 which extends approximately one-half of the way up the total height of box 12. In the preferred embodiment, gasifier box 12 was made 81.3 centimeters wide by 97.8 centimeters long, and extended 212 centimeters above the air entrance openings 36 of air ducts 42, 44, 46 and 48. The throat width at the lowermost edges of air ducts 42, 44, 46 and 48 was approximately 8 centimeters, while channel length was 86 centimeters.

Gasifier box 12 was made of 14 gauge (1.9 millimeter) mild steel and had a capacity of 1.4 cubic meters holding about 256 kilograms of corncobs. When these cobs had burned down about 1 meter, the gasifier box 12 was usually refilled, requiring about 143 kilograms at the usual density of 183 kilograms/cubic meter (11.4 pounds/cubic foot).

Turning now to FIGS. 4 and 5, it can be seen that pressurized air is introduced by blower 16 into air manifold 18. The air then enters air entrance openings 36 and in turn passes through air ducts 42, 44, 46 and 48 where a portion of it, called primary air, is forced out air jet openings 38 into the interior of gasifier box 12. Since the gasifier box 12 is sealed at the top, the combustion products must pass downward through channels 40 and grate 32 and horizontally to the gasifier exits 56.

Air ducts 42, 44, 46 and 48 also have air exit openings 52 at their ends opposite from air entrance openings 36 for the exit of the remaining pressurized air, called secondary air because it is utilized in the combustion of the producer gas, termed secondary combustion. These air exit openings 52 are on the underside of air ducts 42, 44, 46 and 48 and are inside of the back wall of gasifier box 12. Rear baffle plate 54 encloses and isolates air exit openings 52 from the chamber of gasifier box 12. The secondary air discharges into an adjacent secondary combustion chamber through gasifier exits 56. The specialized construction of rear baffle plate 54 is shown in FIG. 5. The mixture of the gas and secondary air formed near gasifier exits 56 is combustible.

The proportion of primary air to secondary air flow is controlled by the relationship between the total area of air jet openings 38 to the total area of air exit openings 52. A ratio of approximately one to one for these total areas was found to produce a mixture which ignited readily and burned cleanly in the secondary combustion chamber. Supplying combustion air by pressure rather than by exhaust suction allows the blower 16 to work at ambient temperatures and provides the necessary pressure for good air jet penetration of the fuel mass.

FIG. 6 shows how the corncobs are processed by the gasifier 10. The sloping sides of air ducts 42, 44, 46 and 48 support most of the corncobs. As the cobs shrink and burn, the partially combusted biomass flows downward by gravity between the sloping sides of air ducts 42, 44, 46 and 48 onto grate 32. The red-hot char then continually accumulates on grate 32. As the bottom layer of this char burns out, ashes are formed. The constant downward flow of the corncobs and char caused by gravity and occasional longitudinal shaking of the grate then drops the ashes through the grate in to the V-shaped troughs 30. When desired, augers 22 may then be rotated to remove this ash.

Operation of downdraft channel gasifier 10 begins with a start-up procedure. Gasifier box 12 is filled with corncobs and the lid 13 is sealingly closed. In one example, about 0.7 liters of diesel fuel is introduced over the full length of the cobs in each channel 40 by inserting a cross-drilled applicator tube through ignition plug 28 in the front of gasifier box 12. Blower 16 is then started and adjusted to produce about one-fourth of the normal air flow. Blower 16 is damper-adjustable to vary the amount of air flow into air ducts 42, 44, 46 and 48. A small propane torch is inserted through each ignition plug 28 to light the fuel-sprinkled cobs in each channel 40. After burning has started, air flow from blower 16 is increased to the desired rate.

To refill gasifier box 12 with corncobs, blower 16 is stopped and gasifier box lid 13 is opened. This procedure may be modified to include an automatic refiller with an air-lock feeding unit which is triggered by the level of cobs inside of gasifier box 12.

The ashes produced by the burning of the cobs are removed periodically via augers 22. Cobs are normally found to have about 1.5% ash and it is assumed that approximately 0.5% is carried out of the exhaust as sub-micron particulates. Therefore, the 1% ash which is deposited in troughs 30 must be removed in order to keep the air passageways to gasifier outlets 56 open.

Once the start-up procedure has been completed, combustion of the cobs takes on the following configuration: A reduction area of red hot char forms above grate 32; a combustion area forms in and around channels 40 above the reduction area; while a pyrolysis zone forms above the combustion zone. Ashes reduced from the char in the reduction zone are deposited in troughs 30 below grate 32.

The gasification product, producer gas is forced down through channels 40 and grate 32 to the tops of V-shaped troughs 30, where it then flows longitudinally down troughs 30 to gas outlets 56.

Burning rates range from 31 kg/h (68 lb/h) for 0.052 $m^3/s$ (110 scfm) of total combustion air to 85 kg/h (187 lb/h) for 0.139 $m^3/s$ (295 scfm).

Temperatures in the lower portion of channels 40 average about 680° C. and range up to 900° C. shortly after start-up before a char bed is formed. Channels 40 are filled with glowing char (shrunken cobs from which all volatiles have been driven off, leaving the carbon), down through which the producer gas flows to gasifier outlets 56. The char burns to ash and drops through the grates into V-shaped troughs 30.

Due to cooling by the primary and secondary air flow, air ducts 42, 44, 46 and 48 which can be made of 12 gauge (27 mm) #304 stainless steel, remain free of slag. The secondary air becomes heated to approximately 300° C., while the producer gas temperatures are on the order of 700° C.

Pyrolysis above the primary combustion zone vaporizes the volatile components of the fuel, primarily heavier, longer-chain hydrocarbon molecules. The resulting thick, yellow smoke fills gasifier box 12 but must exit down through burning cobs and glowing char, thus cracking the tars into lighter molecules. The producer gas which is derived is much clearer and cleaner than that obtained from cross-draft or updraft gasifiers. This gas additionally burns hotter than gas obtained by other processes. No odor is apparent.

Air ducts 42, 44, 46 and 48 being disposed throughout gasifier box 12 and having the plurality of air jet openings 38, obtain a more uniform distribution of air in the fuel mass than previous gasifiers. This produces uniform and evenly heated combustion and reduction zones which work to uniformly break down the tar molecules to produce the cleaner producer gas.

The producer gas exiting at gasifier outlets 56 mixes with the preheated secondary air exiting from air exit openings 52. The mixture can be released into a close-coupled secondary combustion chamber where the gas and air mixture burns to produce heat with little or no odor. The hot exhaust gases can then subsequently be used to dry corn or other crops. They can also pass through a heat exchanger to produce heat for buildings, etc. or through a boiler to produce steam or heat water. It should be noted that the pressurized air coming from blower 16 through air ducts 42, 44, 46 and 48 serves to cool the air ducts, while at the same time preheating the air for more efficient primary and secondary combustion.

To initiate shut-down of gasifier 10, the blower 16 is stopped and the intake damper is closed. Shut down should be initiated when cob depth is not less than 60 centimeters to avoid the simultaneous burning of the entire depth, resulting in complete combustion with attendant high temperatures. As much as 24 hours may be required for the fire to completely die out, and usually, all the cobs are not consumed.

It can thus be seen that the combination of the structural components mentioned herein with a multiple channel downdraft gasifier allows a hotter char to develop, a more efficient hydrocarbon cracking to occur, and a more fuel efficient producer gas to be prepared.

The above description is the preferred embodiment of the invention. However, it is to be understood that changes can be made in the preferred embodiment herein and remain within the boundaries of the invention. In particular, in the preferred embodiment, center air ducts 42 and 44 are of generally triangular shape having two equilateral sides converging downward from an apex edge, along which are positioned air jet openings 38. The base of triangular air ducts 42 and 44 has two segments which slope slightly downward to a center support which carries grates 32. The air ducts are supported at their ends.

Alternatively, by referring to FIG. 7, center air ducts 42 and 44 could be of a strictly triangular configuration, having equilateral sloping sides 60 and a flat base 62 having a mounting support 63 attached at its center. Additionally, replacing the apex edge in this embodiment could be a diamond-shaped apex edge 64 mounted in fluid communication with the interior of air ducts 42 and 44 and having air jet openings 38 longitudinally placed along the diamond-shaped apex edges' downward facing inwardly converging sides 66. This configuration would shield air jet openings 38 from plugging by parts or pieces of biomass fuel or by ashes, while at the same time providing essentially the same supporting apex edge and sloping surfaces for support of biomass. Additionally, this embodiment would allow the exit of producer gas from just below the base of air ducts 42 and 44, as compared to taking it off below grates 32. This would, of course, require that gasifier outlets 56 and baffle plate 54 be revised. Side air ducts 46 and 48 could likewise have their apex edges modified.

What is claimed is:

1. A biomass downdraft channel gasifier having a means for filling said gasifier with biomass comprising:

(a) an enclosed housing defining a biomass gasification chamber;

(b) at least two generally triangularly-shaped hollow air ducts for the transmittal of air, spaced across the width of said gasification chamber, each of said air ducts having an apex edge and at least one sloping side diverging downward from said apex edge, with each of said sloping sides extending convergingly towards a sloping side of an adjacent air duct to define an open-bottom V-shaped channel therebetween for support of said biomass material, said air ducts each having air jet openings disposed longitudinally along their apex edge for outlet of air to said gasification chamber to provide oxygen for gasification of said biomass;

(c) a grate member placed in said gasification chamber below said air ducts which allows passage of gaseous substances and biomass ash, yet supports biomass fuel and char;

(d) means defining air entrance openings in adjacent ends of said air ducts for the reception of said air;

(e) means defining one or more outlets for the producer gas generated in the said gasification chamber.

2. The device of claim 1 wherein ash removal means with gas sealing means is positioned below said grate member.

3. The device of claim 1 wherein a high-pressure air means for supplying said air to said air entrance openings of said air ducts is attached to said housing in fluid communication with said air entrance openings.

4. The device of claim 3 wherein said high-pressure air means has adjustable means to provide varying levels of high-pressure air to said air entrance openings.

5. The device of claim 1 wherein means defining air exit openings are positioned in the adjacent ends of said air ducts opposite the adjacent ends having said air entrance openings and allow the exit of a portion of the entering air externally of said gasification chamber.

6. The device of claim 5 wherein there is a means for mixing said air exiting externally and said producer gas for a secondary combustion.

7. The device of claim 6 wherein the total area of said air jet openings is proportioned to the total area of said air exit openings in each said air duct so as to obtain a combustible air-producer gas mixture.

8. The device of claim 1 wherein said air ducts are made of heat-resistant sheet steel.

9. The device of claim 1 wherein refractory lining protects the high-temperature zone of the interior of said housing.

10. The device of claim 1 wherein said producer gas outlets are positioned so as to be in fluid communication with said gasification chamber below said grate members.

11. The device of claim 1 wherein said apex edge is of a generally diamond-shaped configuration, and said air jet openings are positioned along the lower converging sides of said diamond-shaped apex edge, so that particles of said biomass and ash from the combustion of said biomass do not clog said air jet openings by settling or otherwise blocking said air jet openings.

12. The device of claim 1 wherein said air ducts have a flat base and allow the generated producer gas to be retrieved from the area below the flat base of each duct.

13. The device of claim 12 wherein said producer gas outlets are positioned above said grate members.

14. The device of claim 1 wherein said producer gas outlets are in fluid communication with a secondary combustion chamber for the combustion of a mixture of air and said gaseous contents of said combustion chamber.

15. The device of claim 6 wherein the producer gas and air exit openings are in fluid communication with a secondary combustion chamber for the combustion of a mixture of producer gas and secondary air.

16. A biomass downdraft channel gasifier having a means for filling said gasifier with biomass comprising:

(a) an enclosed housing defining a biomass gasification chamber;

(b) two triangularly-shaped hollow air ducts for the transmittal of air, each positioned upon opposite sides of said biomass gasification chamber and each having a downwardly sloping side having an apex edge, said downwardly sloping sides extending towards each other so that an open-bottom V-shaped channel is formed therebetween for support of said biomass material, having downwardly converging sides, said air ducts having a plurality of air jet openings along said apex edges for outlet of said air to provide oxygen for gasification of said biomass;

(c) a grate member placed in said gasification chamber below said air ducts which allows passage of biomass ash and gaseous substances which have flowed down through said channel yet supports biomass fuel and char;

(d) means defining air entrance openings in adjacent ends of said air ducts for receiption of said air;

(e) means defining an outlet for the producer gas generated in the said gasification-combustion chamber.

17. The device of claim 16 wherein means defining air exit openings in adjacent ends of said air ducts opposite said air entrance openings allow the exit of a portion of the entering air externally of said gasification chamber.

18. A biomass downdraft channel gasifier having a means for filling said gasifier with biomass comprising:

(a) an enclosed housing defining a biomass gasification chamber;

(b) at least two generally triangularly-shaped hollow air ducts for the transmittal of primary combustion air and secondary combustion air spaced across the width of said gasification chamber, each of said air ducts having an apex edge and at least one sloping side diverging downward from said apex edge, with each of said sloping sides extending convergingly towards a sloping side of an adjacent air duct to define an open-bottom V shaped channel therebetween for support of said biomass material, said air ducts each having air jet openings disposed longitudinally along their apex edge for outlet of said primary combustion air to said gasification chamber to provide oxygen for gasification of said biomass, said air ducts each having means defining air exit openings for the outlet of said secondary combustion air from said air ducts;

(c) a grate member placed in said gasification chamber below said air ducts which allows passage of gaseous substances and biomass ash, yet supports biomass fuel and char;

(d) means defining air entrance openings in adjacent ends of said air ducts for the reception of said primary combustion air;

(e) means defining air entrance openings in adjacent ends of said air ducts for the reception of said secondary combustion air;

(f) means defining one or more outlets for the producer gas generated in said gasification chamber.

19. The device of claim 18 wherein said air exit openings are in fluid communication with said outlets for the producer gas to provide means for mixing said secondary combustion air and said producer gas occurs.

* * * * *